US006553921B2

(12) United States Patent
Liu

(10) Patent No.: US 6,553,921 B2
(45) Date of Patent: Apr. 29, 2003

(54) TABLE FRAME FOR FASTENING LOADING MEMBER

(76) Inventor: Lausan Chung-Hsin Liu, No. 243, Chien-Kuo Rd., Hsin-Tien City, Taipei Hsien (TW)

( * ) Notice: Subject to any disclaimer, the term of this patent is extended or adjusted under 35 U.S.C. 154(b) by 0 days.

(21) Appl. No.: 09/903,539

(22) Filed: Jul. 13, 2001

(65) Prior Publication Data

US 2003/0010261 A1 Jan. 16, 2003

(51) Int. Cl.[7] ..... A47B 3/06
(52) U.S. Cl. ..... 108/157.15; 1085/27
(58) Field of Search ..... 108/27, 184, 157.1, 108/157.15, 158, 158.11, 157.18; 248/188

(56) References Cited

U.S. PATENT DOCUMENTS 4,754,714 A * 7/1988 Drumm ..... 108/157.18
4,805,541 A * 2/1989 Drane et al. ..... 108/157.15
4,823,709 A * 4/1989 Tesney ..... 108/157.15
4,905,612 A * 3/1990 Apissomian ..... 108/157.15
4,941,413 A * 7/1990 Vanderminden ..... 108/156
5,404,828 A * 4/1995 Tesney ..... 108/157.15
6,006,679 A * 12/1999 Lin ..... 108/157.15

* cited by examiner

*Primary Examiner*—Janet M. Wilkens
(74) *Attorney, Agent, or Firm*—Bacon & Thomas, PLLC

(57) ABSTRACT

An improved table frame for fastening loading members includes a fastening section extending from a table frame and a plurality of anchor elements fastened to the table frame at locations corresponding to the fastening section. Each anchor element has a first anchor ledge fastened to the table frame and an anchor flange opposing the fastening section to form a housing space therebetween. The housing space has a height matching the thickness of a loading member for holding the loading member. The anchor elements are fastened to the table frame through fasteners thereby allow the loading member held securely on the table frame.

8 Claims, 5 Drawing Sheets

TABLE FRAME FOR FASTENING LOADING MEMBER

BACKGROUND OF THE INVENTION

The present invention relates to an improved table frame for fastening a loading member and particularly a table frame that forms a housing space with an anchor element for holding the loading member.

Conventional table frames made of metal for holding a glass table top are generally constructed in two types as shown in FIGS. 1 and 2. One is to form a circular table frame with a stepwise indented circular recess formed therein to serve as a supporting zone. Then a round glass may be placed in the supporting zone to become a finished table. As the glass and table frame are made by different parties, the supporting zone must be reserved with some allowance to compensate the possible dimensional variation of the glass (resulting from fabrication process). That allowance usually becomes a gap between the glass and table frame. After the table being used for a period of time, the gap tends to collect dust and leaves and other articles. It is difficult to clear and clean. Moreover, the glass and table frame are separate items. Their transportation and storage become a huge problem to the producers and users. The fragile and delicate nature of the glass is especially troublesome. A little negligence or mishandling could easily cause the glass scratched, damage, or broken. Repairs for the damages are difficult. To avoid unnecessary damages, extra guarding measures must be employed (such as using corrugated boards for packaging and transporting the glass). This will result in additional production and transportation costs. Furthermore, the glass is very rigid and brittle. To do finishing work such as drilling holes for matching the table legs is difficult and problematic.

Another type of table frame is having one separated and opening side. The table frame has extending upper and lower side to form a holding space. The glass is slid from the opening side into the holding space bordering by three lateral sides of the table frame. Then the separated side is wedged to seal the opening for holding the glass in the table frame. Another alternative is making the table frame in the form of four separated brackets. Then wedge the four brackets to the four lateral sides of the glass, and fasten the four brackets together. This method is applicable only to rectangular table frames and glass, but is not suitable for round or ellipsoidal or other curve-shaped table frames. The glass also requires some drilling work to match the table legs. All this creates annoying problems for the producers and users. There are still rooms for improvements.

SUMMARY OF THE INVENTION

The primary object of the invention is to resolve the foregoing disadvantages. The present invention provides a table frame that has an integral fastening section extended inwards and a plurality of anchor elements corresponding to the fastening section. The anchor element has a first anchor ledge fastened to the table frame and an anchor flange opposing the fastening section to form a housing space with a height of the thickness of a loading member for holding the loading member in the housing space. Then the anchor ledge is fastened to the table frame through a fastener. Such a structure is adaptable to any type of table frames and loading members.

Another object of the invention is to form an integral coupling sleeve with the anchor flange for matching the exterior of the table leg such that the table leg may be inserted into the coupling sleeve and be fastened therein through a fastener.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
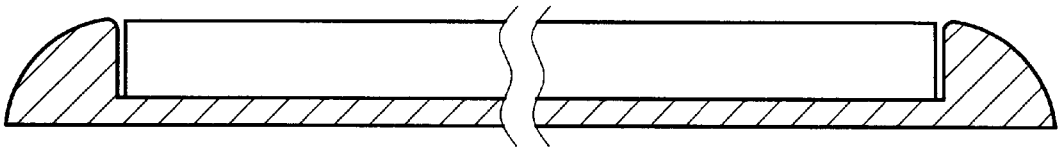
Fig.1 PRIOR ART
FIGS. 1 and 2 are schematic views of a conventional table frame and glass assembly.
Figure 2:
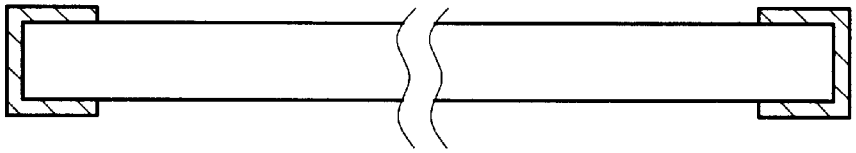
Fig.2 PRIOR ART
Figure 3:
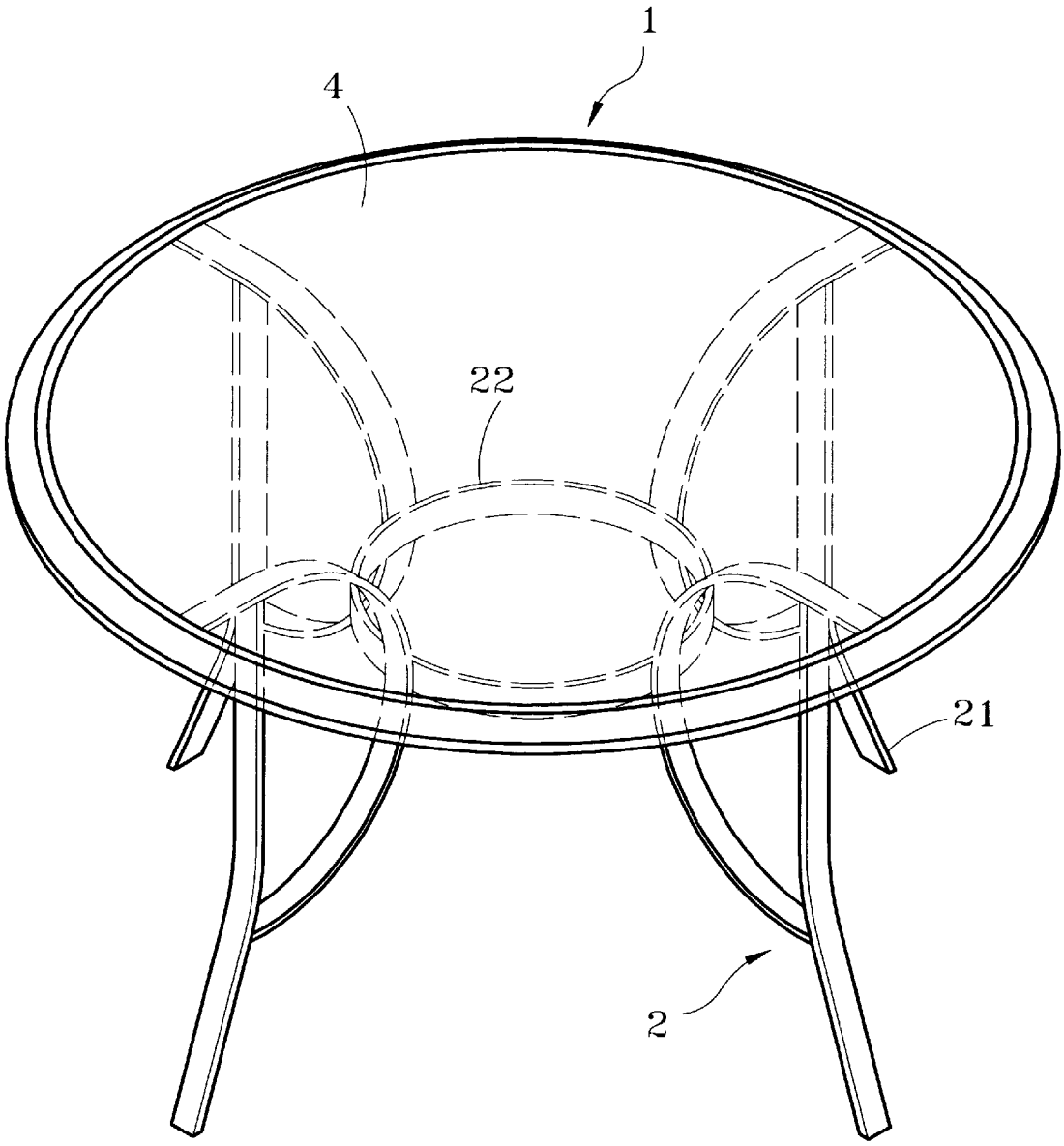
FIG. 3 is a perspective view of the present invention.
Figure 4:
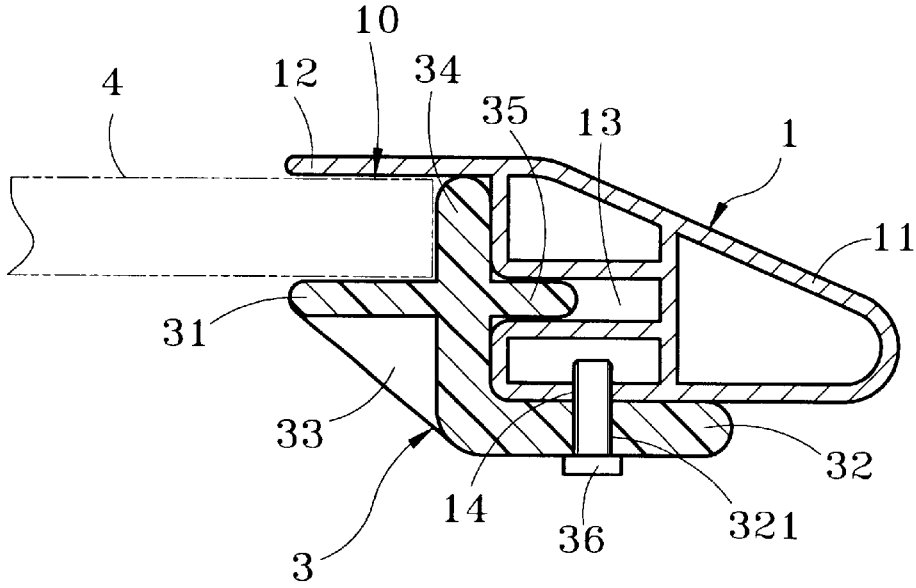
FIG. 4 is a fragmentary sectional view of the present invention.
Figure 5:
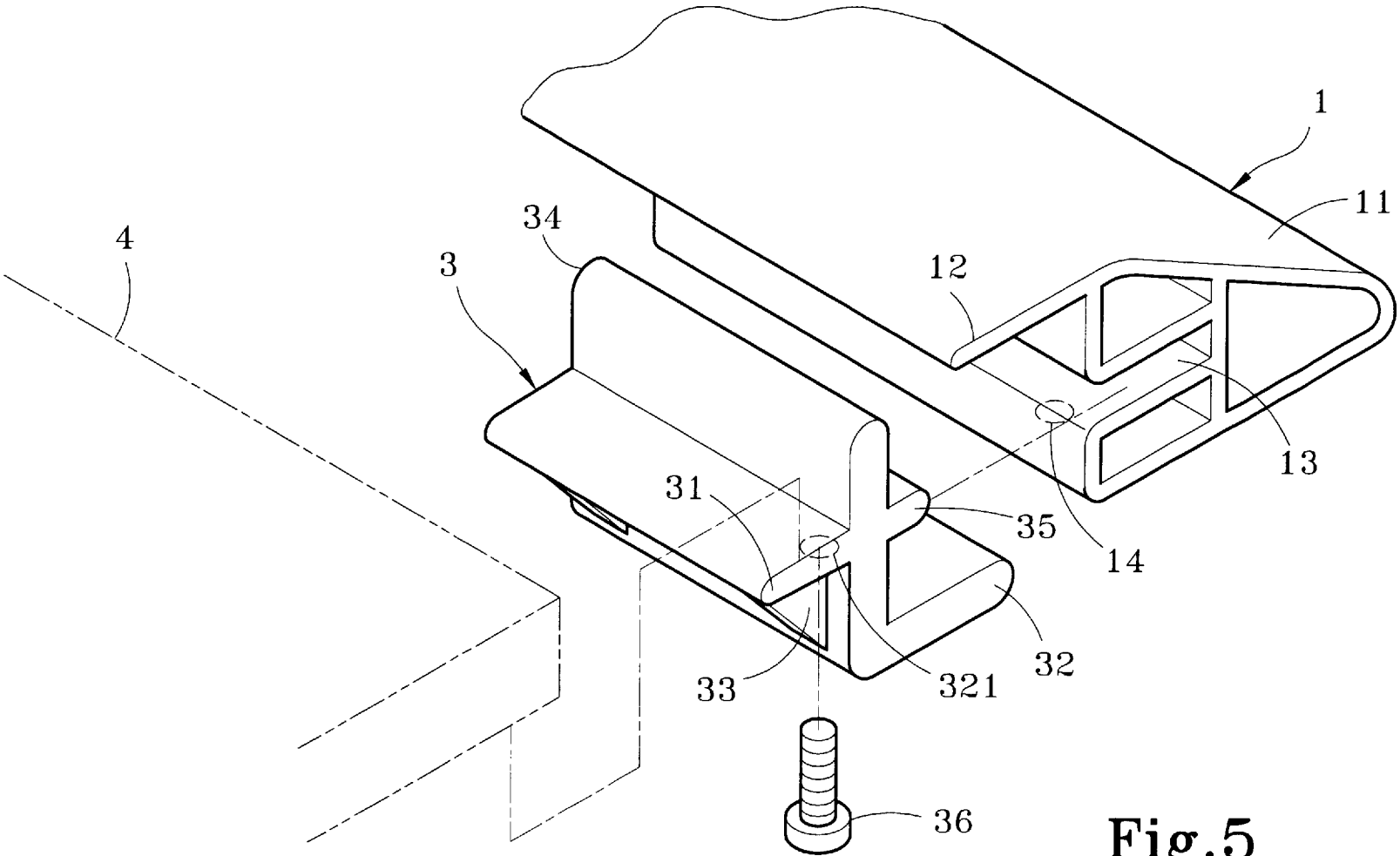
FIG. 5 is an exploded view of the invention according to FIG. 4.

Referring to FIGS. 3, 4 and 5, a round table frame 1 is being used as an embodiment example. The present invention includes a fastening section 12 integrally formed with the table frame 1 and extended inwards. The table frame 1 and fastening section 12 are bridged by a slant ornamental surface 11 to augment the aesthetic appealing of the table frame 1. There are a plurality of anchor elements 3 corresponding to the fastening section 12. Each anchor element 3 has a first anchor ledge 32 fastenable to the table frame 1 and an anchor flange 31 opposing to the fastening section 12 to form a housing space 10 therebetween with a height matching the thickness of a loading member 4. The first anchor ledge 32 and table frame 1 have respectively a fastening aperture 321 and 14 formed therein matching with each other. The loading member 4 (glass is being used in the embodiment) may be wedged and held in the housing space 10 between the fastening section 12 and anchor flange 31. As the loading member 4 has dimensional allowance during fabrication and will not fully fill the housing space 10, a jut 34 is provided in the housing space 10 to fill the void that might take place. Furthermore, in order to enhance the bonding and supporting power of the anchor element 3, the table frame 1 has a wedge trough 13 formed therein. The anchor element 3 has a second anchor ledge 35 with a thickness matching the wedge trough 13 for wedging into the wedge trough 13. In addition, there is a reinforced rib 33 formed between the anchor element 3 and anchor flange 31 to further increase the supporting power. After the aforesaid elements are assembled in place, use a fastener 36 to engage fastening aperture 321 of the first anchor ledge 32 to the aperture 14 of the table frame 1. Thereby the loading member 4 will be securely fastened and held on the table frame 1. The number of the anchor element 3 may be adjusted based on the weight of the loading member 4 to provide the supporting power required.

Figure 6:
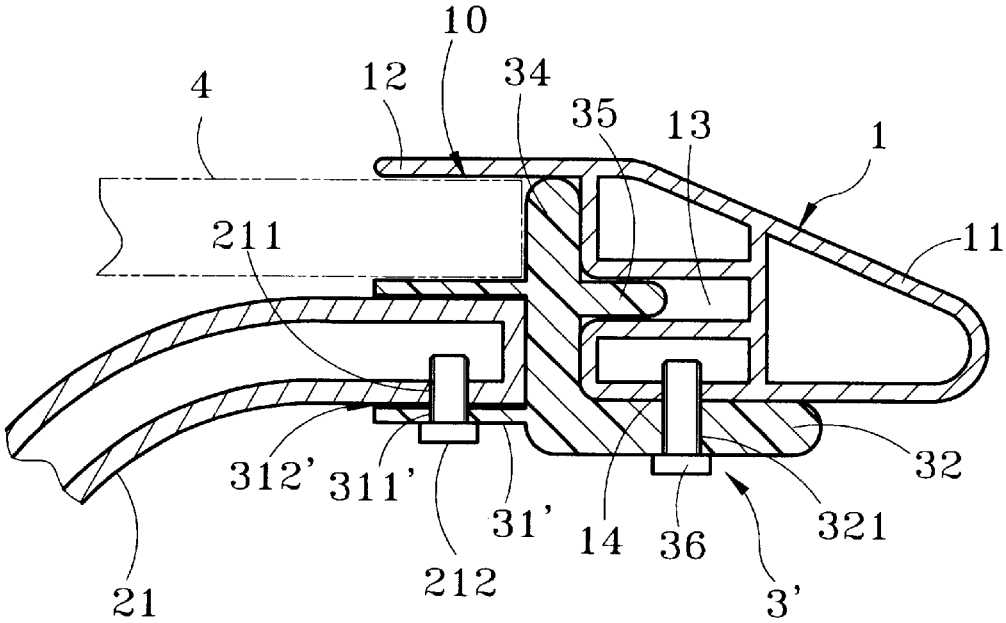
FIG. 6 is an exploded view of another embodiment of the invention.
Figure 7:
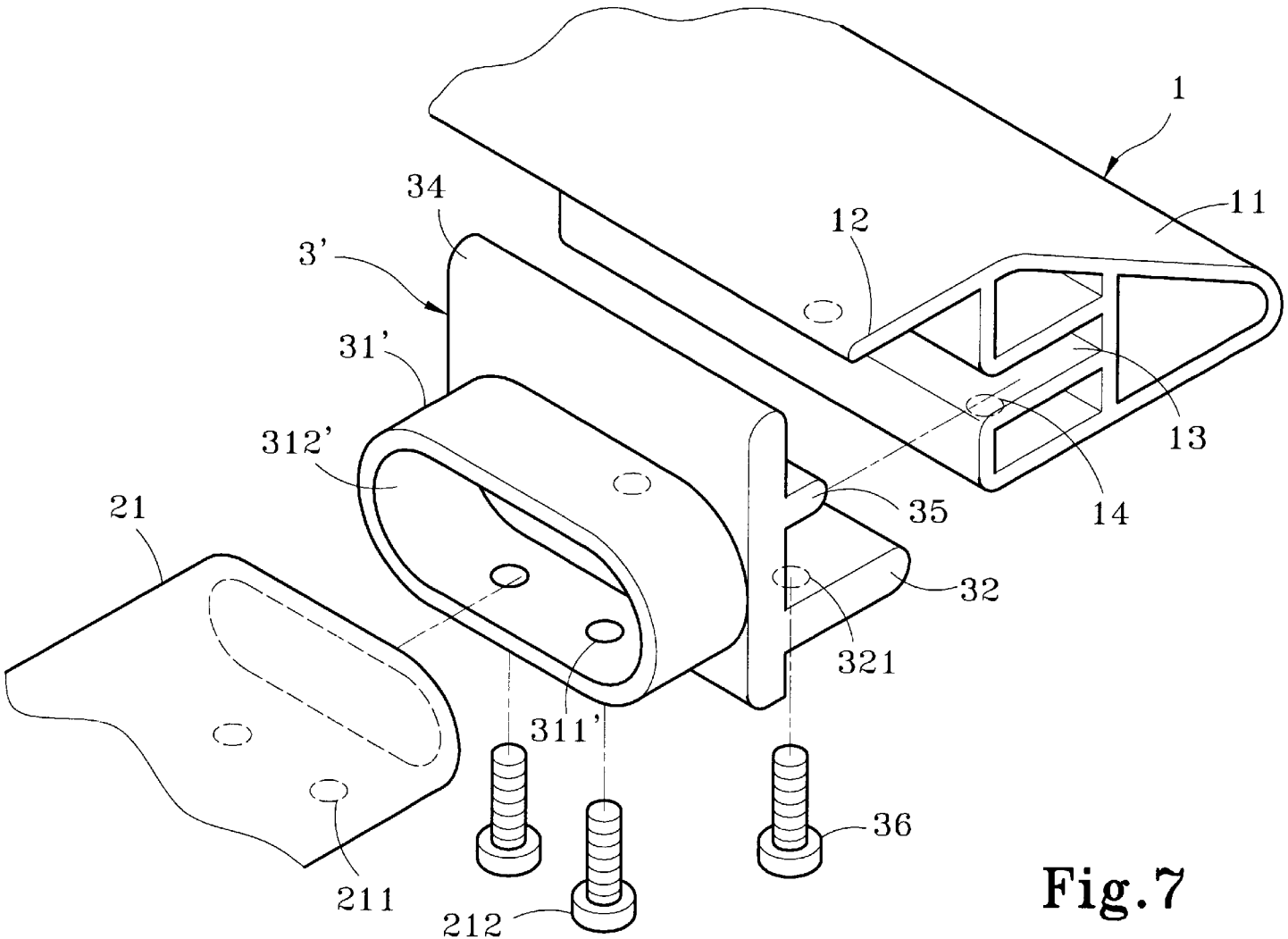
FIG. 7 is a sectional view of the invention according to FIG. 6.

Referring to FIGS. 3, 6 and 7 for another embodiments of the invention, the anchor element 3' is adapted to fasten the table frame 1 and the leg 21 of the leg support 2 of the table. The four legs 21 of the leg support 2 form a supporting plane through a linkage means. The anchor flange 31' of the anchor element 3' is extended integrally to form a coupling sleeve 312' matching the exterior of the leg 21. Thus the leg 21 may be inserted into the coupling sleeve 312'. And through a fastener 212 to engage apertures 311' and 211 formed respectively on the coupling sleeve 312' and leg 21, the anchor element 3' may be fastened to the leg 21 securely. Thereby the loading member 4 and table frame 1 may also be fastened to the legs 21 securely. Besides allowing the anchor elements 3' to provide more loading support power, this embodiment also overcomes the not fastenable problem between table legs 21 and the table frame 1 or loading member 4 that incurs to the conventional tables. By means of the construction set forth above, it clear shows that the invention provides a better fastening and assembling means for the table frame 1, loading member 4 and table leg support 2.

While the preferred embodiments of the invention have been set forth for the purpose of disclosure, modifications of the disclosed embodiments of the invention as well as other embodiment thereof may occur to those skilled in the art. Accordingly, the appended claims are intended to cover all embodiments which do not depart from the spirit and scope of the invention.

What is claimed is:

1. An improved table frame for fastening a loading member, comprising:

a table frame extending inwards to form a fastening section;

a plurality of anchor elements fastened to the table frame at locations corresponding to the fastening section, each of the anchor elements including a first anchor ledge fastened to the table frame and an anchor flange opposing to the fastening section to form a housing space therebetween, the housing space having a height matching the thickness of the loading member;

wherein the loading member being wedged into the housing space, and the first anchor ledge being fastened to the table frame through a fastener to form a secured fastening between the loading member and the table frame; and wherein the table frame has a wedge trough formed therein, the anchor element having a second anchor ledge matching the thickness of the wedge trough.

2. The improved table frame for fastening a loading member of claim 1, wherein the table frame and the fastening section are bridged by a slant ornamental surface.

3. The improved table frame for fastening a loading member of claim 1, wherein the anchor element has a jut extending into the housing space for filling the void incurred when the loading member is wedged into the housing space.

4. The improved table frame for fastening a loading member of claim 1, wherein the anchor flange is integrally extended to form a coupling sleeve for matching an exterior of a table leg for receiving and fastening the table leg through a fastener.

5. An improved table frame for fastening a loading member, comprising:

a table frame extending inwards to form a fastening section;

a plurality of anchor elements fastened to the table frame at locations corresponding to the fastening section, each of the anchor elements including a first anchor ledge fastened to the table frame and an anchor flange opposing to the fastening section to form a housing space therebetween, the housing space having a height matching the thickness of the loading member;

wherein the loading member being wedged into the housing space, and the first anchor ledge being fastened to the table frame through a fastener to form a secured fastening between the loading member and the table frame; and a reinforced rib located between the anchor ledge and anchor flange for enhancing the supporting power of the anchor element.

6. The improved table frame for fastening a loading member of claim 5, wherein the table frame and the fastening section are bridged by a slant ornamental surface.

7. The improved table frame for fastening a loading member of claim 5, wherein the anchor element has a jut extending into the housing space for filling the void incurred when the loading member is wedged into the housing space.

8. The improved table frame for fastening a loading member of claim 5, wherein the anchor flange is integrally extended to form a coupling sleeve for matching an exterior of a table leg for receiving and fastening the table leg through a fastener.

* * * * *